US006152822A

United States Patent [19]

Herbert

[11] Patent Number: 6,152,822

[45] **Date of Patent: *Nov. 28, 2000**

[54] WAGERING SYSTEM AND METHOD OF WAGERING

[76] Inventor: Richard A. Herbert, 390 River Bluff Cir., Naperville, Ill. 60540

[ * ] Notice: This patent is subject to a terminal disclaimer.

[21] Appl. No.: 09/007,710

[22] Filed: Jan. 15, 1998

Related U.S. Application Data

[63] Continuation-in-part of application No. 08/816,872, Mar. 13, 1997, Pat. No. 5,888,136.

[51] Int. Cl.[7] ..... A63F 9/22

[52] U.S. Cl. ..... 463/22; 463/25; 463/20; 463/16

[58] Field of Search ..... 463/22, 25, 16, 463/17, 18, 19, 20, 40, 41, 42, 28; 273/143 R

[56] References Cited

U.S. PATENT DOCUMENTS 5,180,309 1/1993 Egnor .
5,275,400 1/1994 Weingardt et al. .
5,330,185 7/1994 Wells .
5,332,218 7/1994 Lucey .
5,476,259 12/1995 Weingardt .
5,518,239 5/1996 Johnston .
5,560,603 10/1996 Seelig et al. .
5,564,701 10/1996 Dettor .
5,888,136 3/1999 Herbert ..... 463/22

*Primary Examiner*—Jessica J. Harrison
*Assistant Examiner*—Julie Kasick
*Attorney, Agent, or Firm*—Wood, Phillips, VanSanten, Clark & Mortimer

[57] ABSTRACT

A method of wagering, including the steps of providing a random number generator that has a wagering base which is randomly accessed by an input wager, using as at least a part of the wagering base the outcome of at least one horse/dog race or jai alai game that has been completed, pre-assigning a probability value to the outcome of the at least one horse/dog race or jai alai game and programming the random number generator so that the probability of accessing the outcome of the at least one horse/dog race or jai alai game in the random number generator through an input wager identifying the outcome of the at least one horse/dog race or jai alai game is correlated to the probability value, directing an input wager identifying the outcome of the at least one horse/dog race or jai alai game to the random number generator, and identifying a return for an input wager identifying the outcome of the at least one horse/dog race or jai alai game that accesses the outcome of the at least one horse/dog race or jai alai game in the random number generator.

61 Claims, 4 Drawing Sheets

WAGERING SYSTEM AND METHOD OF WAGERING

CROSS REFERENCE

This application is a continuation-in-part of my application Ser. No. 08/816,872 filed Mar. 13, 1997 entitled "Wagering System and Method of Wagering" now U.S. Pat. No. 5,88,136, issued on Mar. 30, 1999.

BACKGROUND OF THE INVENTION

1. Field of the Invention

This invention relates to the gaming industry and, more particularly, to a method of wagering using the outcome of horse/dog races, jai alai games, or the like, as at least a part of a wagering base. The invention is also directed to a wagering system of the type through which the inventive wagering method can be practiced.

2. Background of the Invention

The financial impact of legal gaming on local, national, and international economies is staggering. One source has estimated that, in 1992, Americans spent more on lotteries, race tracks, casinos, and the like, than on movies, books, amusement attractions and recorded music collectively. This same source has estimated that more Americans went to casinos than attended major league baseball games in the U.S. in the year 1993.

The financial heart of the casinos is the slot machine, which has been drawing an increasing percentage of wagers in casinos. Aside from the versatility that modem slot machines afford, they are desirable because they appeal to all levels of gambling expertise. Novices need not contend with the embarrassment of not knowing the mechanics of a particular game, nor does the novice need to study probabilities to make a calculated wager. The intimidation by the table games, the operators thereof, and other observing players has discouraged many players from participating in table games. With a slot machine, on the other hand, the individual need only operate a switch through a button or lever, with the results being entirely random and beyond the operator's control. Slot machines are also desirable because they are commonly set up in state-of-the-art facilities which are highly attractive to the bettor.

The success of the slot machine has had a devastating effect on live track revenues from pari-mutuel betting. Existing legislation in most states has precluded the location of slot machines and other casino games on track premises. These tracks have been relegated to a one dimensional identity, which has resulted in a migration of gamers to casinos. While off-track betting has breathed some life into pari-mutuel betting, many tracks have closed or are anticipating closure in the very near future due to lowering profitability.

The tracks are handicapped by having higher commissions (18–35%) than casinos (0.5% to 11%). Still further, success at a track generally requires extensive study of both race forms and race results as well as an intimate understanding of handicapping. Added to this is the public perception that many track races are "fixed". Still further, many race tracks have undesirable, antiquated facilities, causing people interested in live races to instead frequent off-track facilities.

It is clear that to halt and reverse the downward trend at race tracks, some stimulus must be given to bettors, in the form of more and different betting opportunities, increased potential winnings, etc. Some tracks have already experienced a financial turnaround attributable largely to the legalization of slots thereat.

However, there is an ongoing battle between legislatures that respect the public sentiment to resist the expansion of gambling and lobbyists for the racing industry that see slot machines as a key to survival of these tracks. Survival of race tracks is in the interest of not only those that own these facilities but also of those in peripheral employment. One study by the American Horse Council Federation estimated that there are in excess of seven million participants as horse owners, service providers, and employees, exclusive of spectators. This same study estimated that the horse industry produces goods and services valued at over 25 billion and pays nearly two billion in taxes on all government levels. Since legislative action to permit slot machines and other games is not imminent in many jurisdictions, some remedy for the current race track crisis is necessary.

SUMMARY OF THE INVENTION

One aspect of the present invention is directed to a method of wagering, including the steps of providing a random number generator that has a wagering base which is randomly accessed by an input wager, using as at least a part of the wagering base the outcome of at least one horse/dog race or jai alai game that has been completed, pre-assigning a probability value to the outcome of the at least one horse/dog race or jai alai game and programming the random number generator so that the probability of accessing the outcome of the at least one horse/dog race or jai alai game in the random number generator through an input wager is correlated to the probability value, directing an input wager identifying the outcome of the at least one horse/dog race or jai alai game to the random number generator and identifying a return for an input wager identifying the outcome of the at least one horse/dog race or jai alai game that accesses the outcome of the at least one horse/dog race or jai alai game in the random number generator.

Through the above method, pari-mutuel wagering can be carried out in a "slot machine" format.

The method may further include the steps of providing multiple locations from which input wagers are directed to the random number generator and directing input wagers to the random number generator from each of the multiple locations.

With this arrangement, it is possible to network the wagering to increase the handle.

The return may be identified based upon the number of input wagers identifying the outcome of the at least one horse/dog race or jai alai game that access the outcome of the at least one horse/dog race or jai alai game through the random number generator.

Through this method, a pari-mutuel betting pool is set up.

The method may further include the step of identifying a predetermined wager period and directing an input wager to the random number generator only during the predetermined wager period. A preliminary return amount may be identified for an input wager identifying the outcome of the at least one horse/dog race or jai alai game that accesses the outcome of the at least one horse/dog race or jai alai game through the random number generator before the expiration of the predetermined wager period.

A final return amount may be identified for each input wager identifying the outcome of the at least one horse/dog race or jai alai game through the random number generator after the expiration of the predetermined wager period based upon the total number of input wagers from each of the multiple locations identifying the outcome of the at least one horse/dog race or jai alai game that access the outcome of the at least one horse/dog race or jai alai game through the random number generator.

The wagering base may include additional information which is pre-assigned a second probability value. The random number generator can be programmed so that the probability of accessing the additional information in the random number generator through an input wager identifying the additional information is correlated to the second probability value. An input wagering terminal can be provided with a selector to allow an input wager to be selectively identified as one of a) the outcome of the at least one horse/dog race or jai alai game and b) the additional information. The method involves directing an input wager identifying the additional information to the random number generator with a return being identified for an input wager identifying the additional information that accesses the additional information through the random number generator.

The input wagering terminal can be operated to cause an input wager to be randomly identified as at least one of a) the outcome of the at least one horse/dog race or jai alai game and b) the additional information and directed to the random number generator.

The input wager can be directed to the random number generator by processing a discrete object that is inserted into the terminal. This object can be in the form of a card, bill, coin, ticket, and the like.

In one form, the input wagering terminal has a repositionable element that is accessible to an operator. The discrete object is processed by repositioning the repositionable element after the discrete object is inserted.

The method may further include the steps of identifying a money value for each input wager, determining a cumulative money pool value for the total input wagers made from the two locations identifying the outcome of the at least one horse/dog race or jai alai game that access the outcome of the at least one horse/dog race or jai alai game through the random number generator, and identifying a return to each input wager identifying the outcome of the at least one horse/dog race or jai alai game that accesses the at least one horse/dog race or jai alai game based on the cumulative money pool value.

To give the location around the input wagering terminal a more realistic feel, an audio and/or visual signal can be produced to one of a) simulate an equestrian event, b) simulate a live race environment, c) assist placement of input wagers, d) identify the beginning of a wagering period, e) identify the end of a wagering period, f) simulate a live game environment, g) audibly or visually reproduce at least part of the at least one horse/dog race or jai alai game, h) audibly or visually broadcast an actual horse/dog race in real time, and i) audibly or visually broadcast an actual jai alai game in real time.

The method may further include the steps of operating the random number generator for a predetermined wagering period and identifying an updated payout odds value for accessing the outcome of the at least one horse/dog race or jai alai game in the random number generator through an input wager identifying the outcome of the at least one horse/dog race or jai alai game, which updated payout odds value may change from the pre-assigned probability value based upon the number of input wagers identifying the outcome of the at least one horse/dog race or jai alai game that have accessed the outcome of the at least one horse/dog race or jai alai game in the random number generator. This updating of payout odds values can occur at time intervals selected by the operator.

The method may further include the steps of printing a receipt which identifies that an input wager identifying the outcome of the at least one horse/dog race or jai alai game has accessed the outcome of the at least one horse/dog race and jai alai game in the random number generator.

The invention is also directed to a wagering system having a random number generator that has a wagering base which is randomly accessed by an input wager, with the wagering base defined by the outcome of at least one horse/dog race or jai alai game that has been completed with a pre-assigned probability value for accessing the outcome of the at least one horse/dog race or jai alai game through each input wager, and a first input wagering terminal for directing an input wager identifying the outcome of the at least one horse/dog race or jai alai game to the random number generator.

A second terminal can be provided for directing an input wager identifying the outcome of the at least one horse/dog race or jai alai game to the random number generator.

A processor can be provided for determining the number of input wagers directed from the first and second terminals to the random number generator identifying the at least one horse/dog race or jai alai game and accessing the at least one horse/dog race or jai alai game in the random number generator.

The first terminal may include an actuator switch for causing an input wager to be directed to the random number generator.

In one form, the first terminal has structure responsive to the insertion of a discrete object by an operator to direct an input wager to the random number generator.

Additional information with a pre-assigned probability value for accessing the additional information through each input wager can be used to define another part of the wagering base. A selector can be set in first and second states and in the first state causes an input wager directed to the random number generator to be identified as the at least one horse/dog race or jai alai game. In the second state, the selector causes an input wager directed to the random number generator to be identified as the additional information.

The additional information can be information on the outcome of a horse/dog race or jai alai game that has been completed. The race can be related to the at least one race or a separate race.

In one form, at least one of the pre-assigned probability values is the same as the probability of the outcome of the horse/dog race or jai alai game to which it relates.

A selector may be used to cause the input wager directed to the random number generator to be randomly identified as the at least one horse/dog race or jai alai game and the additional information.

A generator may be provided at the input wagering terminal for producing at least one of an audio and visual signal to at least one of a) simulate an equestrian event, b) simulate a live race environment, c) assist placement of input wagers, d) identify the beginning of a wagering period, e) identify the end of a wagering period, f) simulate a live game environment, g) audibly or visually reproduce at least part of the at least one horse/dog race or jai alai game, h) audibly or visually broadcast an actual horse/dog race in real time, and i) audibly or visually broadcast an actual jai alai game in real time.

The wagering system may further include a processor for determining an updated payout odds value for accessing the outcome of the at least one horse/dog race or jai alai game in the random number generator through an input wager may change from the pre-assigned probability value based upon the number of input wagers identifying the outcome of the at least one horse/dog race or jai alai game that have accessed the outcome of the at least one horse/dog race or jai alai game in the random number generator.

A printer may be provided for producing a receipt which identifies that an input wager identifying the outcome of the at least one horse/dog race or jai alai game has accessed the outcome of the at least one horse/dog race or jai alai game in the random number generator.

The invention also contemplates a wagering system having a random number generator with a wagering base that is randomly accessed through an input wager and having as at least one part of the wagering base the outcome of at least one horse/dog race or jai alai game which has already been completed and which has a pre-assigned probability value. The random number generator is programmed so that the probability of accessing the outcome of the at least one horse/dog race or jai alai game in the random number generator through an input wager identifying the outcome of the at least one horse/dog race or jai alai game is correlated to the pre-assigned probability value.

A processor can be provided for determining an updated payout odds value for accessing the outcome of the at least one horse/dog race or jai alai game in the random number generator through an input wager identifying the outcome of the at least one horse/dog race or jai alai game that may change from the pre-assigned probability value based upon the number of input wagers identifying the outcome of the at least one horse/dog race or jai alai game that have accessed the outcome of the least one horse/dog race or jai alai game in the random number generator. The processor can update the payout odds values at time intervals selected by the operator.

A display may be provided for identifying to a user of the wagering system the updated probability values.

A slot/opening may be provided for accepting a coin to initiate the direction of an input wager to the random number generator.

A reader/scanner may be provided for identifying information on a card to initiate the direction of an input wager to the random number generator.

A printer may produce a receipt which identifies that an input wager identifying the outcome of the at least one horse/dog race or jai alai game has accessed the outcome of the at least one horse/dog race or jai alai game in the random number generator.

A processor may identify a preliminary return amount to be paid to a user that has accessed the outcome of the at least one horse/dog race or jai alai game in the random number generator through an input wager identifying the outcome of the at least one horse/dog race or jai alai game, which preliminary return is based on the total number of input wagers identifying the outcome of the at least one horse/dog race or jai alai game that have accessed the outcome of the at least one horse/dog race or jai alai game after a predetermined wagering period.

The processor may identify a final return amount to be paid to a user that has accessed the outcome of the at least one horse/dog race or jai alai game in the random number generator through an input wager identifying the outcome of the at least one horse/dog race or jai alai game, which amount is based upon the conclusion of a wagering period that extends beyond the predetermined wagering period.

The wagering system may include multiple locations at which input wagers are directed to the random number generator.

The wagering base and the random number generator may include additional information that is assigned a second probability value, with the random number generator being programmed so that the probability or accessing the additional information in the random number generator through an input wager identifying the additional information is correlated to the second probability value. A selector allows an input wager to the random number generator to be selectively identified as a) the outcome of the at least one horse/dog race or jai alai game or b) the additional information.

The wagering system may include a repositionable element that is repositioned by an operator to cause an input wager to be directed to the random number generator.

The repositionable element may be a lever that is pivotable.

A generator may be provided for at least one of an audio and a video signal to at least one of a) simulate an equestrian event, b) simulate a live race environment, c) assist placement of input wagers, d) identify the beginning of a wagering period, e) identify the end of a wagering period, f) simulate a live game environment, g) audibly or visually reproduce at least part of the at least one horse/dog race or jai alai game, h) audibly or visually broadcast an actual horse/dog race in real time, and i) audibly or visually broadcast an actual jai alai game in real time.

An actuator switch may be provided that is operable by a user of the wagering system to direct an input wager to the random number generator.

DETAILED DESCRIPTION OF THE DRAWINGS

Figure 2:
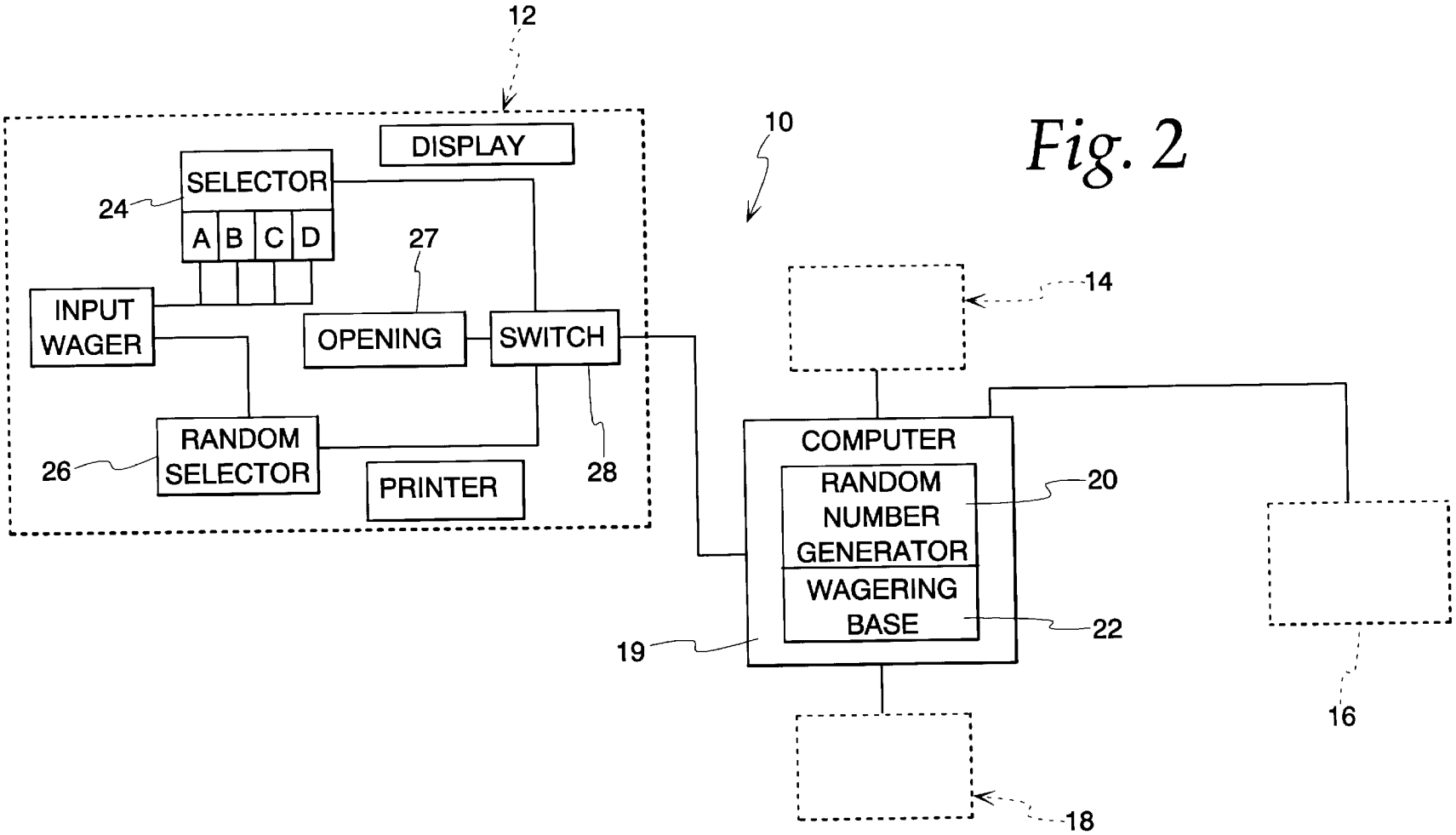
FIG. 2 is a schematic representation of a system for wagering, according to the present invention.

A system for wagering, according to the present invention, is shown at 10 in FIG. 2. The system 10 consists of, in this case, four input wagering terminals 12, 14, 16, 18 through which a bettor makes a wager. The terminals 12, 14, 16, 18 are the same, with only the terminal 12 shown and described herein in any detail. It should be understood that any number of terminals 12, 14, 16, 18 can be used. The invention contemplates that a single terminal 12, 14, 16, 18 could be employed. Alternatively, a multitude of terminals 12, 14, 16, 18 can be linked at the same location, intrastate, interstate and/or internationally.

The invention contemplates that pari-mutuel betting, as permitted in most jurisdictions at live race tracks and jai alai facilities, can be carried out in a "slot machine" format. That is, the bettor can realize the advantages of slot machines, with there being potentially different intriguing elements and features added to the basic slot machine function, as described below.

According to the invention, the system utilizes a computer/processor 19 with a random number generator 20 which has a wagering base 22 made up at least in part by the outcome of at least one live race or a jai alai game. Multiple random number generators 20 could be used. The race is preferably a horse or dog race that has already been run. The wagering base 22 does not have to include exclusively outcomes of completed races or games. Further, it should be understood that the invention pertains to any event on which pari-mutuel betting is permitted and is thus not limited to live races and jai alai games. For purposes of illustration, the description herein will be focussed on live races. However, the mechanics of operation are the same for betting on the outcome of jai alai games or other event outcomes on which there is pari-mutuel betting.

The random number generator 20 is programmed so that the probability of "accessing" a particular outcome is correlated to the actual race outcome. For example, the separate odds of a win, perfecta, trifecta and superfecta can be programmed in with the odds of "accessing" the separate outcomes by directing an input wager to the random number generator 20 being based on the actual race odds. Preferably, the odds and resulting payouts are substantially the same for the outcomes in the "weighted" random number generator 20 as the corresponding outcome in the actual race from which the outcomes were taken, but some chance derived variations in odds are acceptable and even beneficial in enriching the complexities of play. As used herein, "access" is used to generically identify a "win" situation, regardless of how the particular wager is input to the random number generator 20 and regardless of how the random number generator 20 actually receives and processes the input wager.

Exemplary input wagering terminal 12 has a number of options for the bettor. For purposes of simplicity, the system 10 will be described with four potential bet options. These options are only exemplary and should not be viewed as limiting. A first selector 24 can be operated and placed in different states to choose bet options A, B, C, D and any combination thereof, with A corresponding to the win, B corresponding to the perfecta, C corresponding to the trifecta, and D corresponding to the superfecta. Alternatively, the bettor can employ a random selector 26 which causes the input wager to be randomly distributed to one or more of the bet options A, B, C, D that are directed to the random number generator 20.

To make a bet, the bettor places a discrete object, which may be a coin, bill, ticket, card, etc., into an opening 27 in the input wagering terminal 12. The bettor then makes a decision as to use of the selector 24 or the random selector 26. If the selector 24 is used, the desired bet is identified. The input wager identifying the chosen option(s) A,B,C,D is then directed to the random number generator 20 by activating a switch 28. The computer/processor 19 processes all the input wagers, determining the total pool of input wagers, and identifying the number of "winners" that will split the pool. A "winner", as used herein, is an input wager identifying a certain outcome/result which is directed to the random number generator 20 and "accesses" that same outcome/result. The computer/processor 19 causes the input wagers that are "losers" to be immediately discarded to avoid further processing other than to identify the wager amount.

Figure 1:
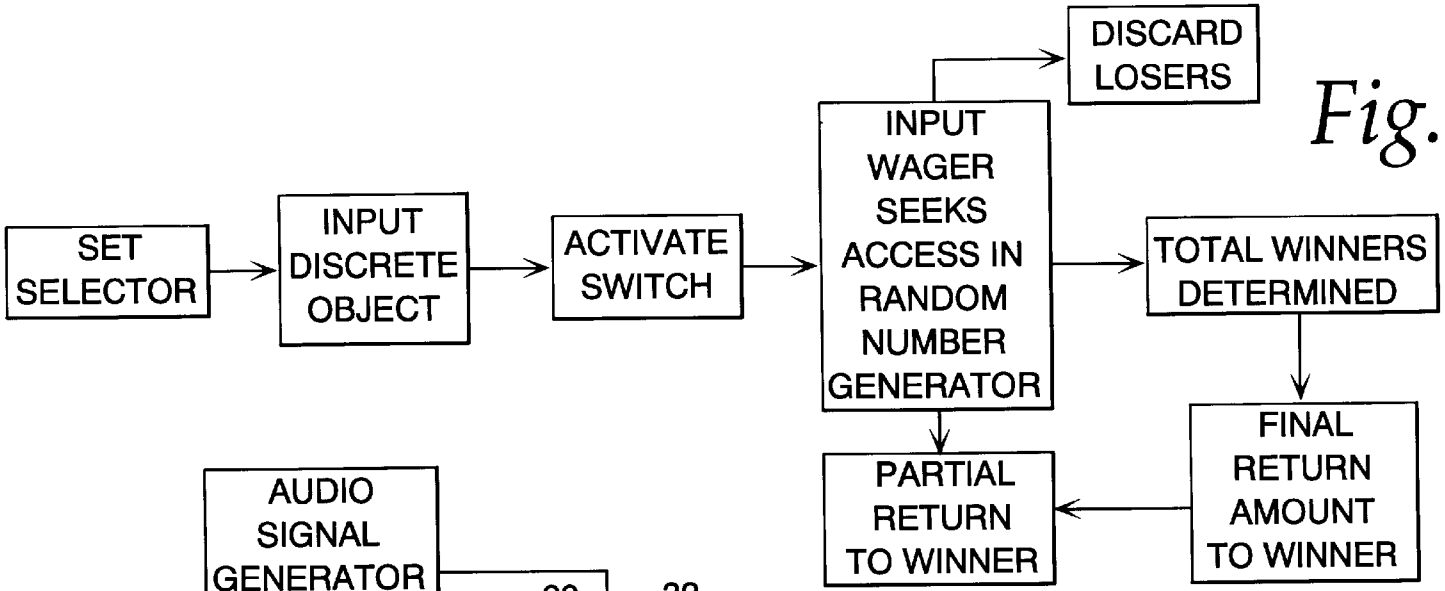
FIG. 1 is a flow diagram illustrating a method of wagering according to the present invention.

One feature of slot machines that makes them particularly desirable is the immediate return that a winner realizes. Another aspect of the invention is the initial identification of the "winners" through the computer/processor 19 and the immediate pay off of a preliminary, partial return amount. The amount of the partial return to the winner is conservatively estimated based upon calculated probabilities. At the conclusion of the wagering period, the total pool of input wagers and winners is identified to determine the final return amount to be paid to each winner. This wagering process is shown in flow diagram form in FIG. 1. Conservative estimates on the immediate partial return amount, particularly to large jackpot winners, would not significantly dampen the enthusiasm for these games in that the winner would experience the thrill of anticipating a relatively large, but unknown, payoff.

Figure 3:
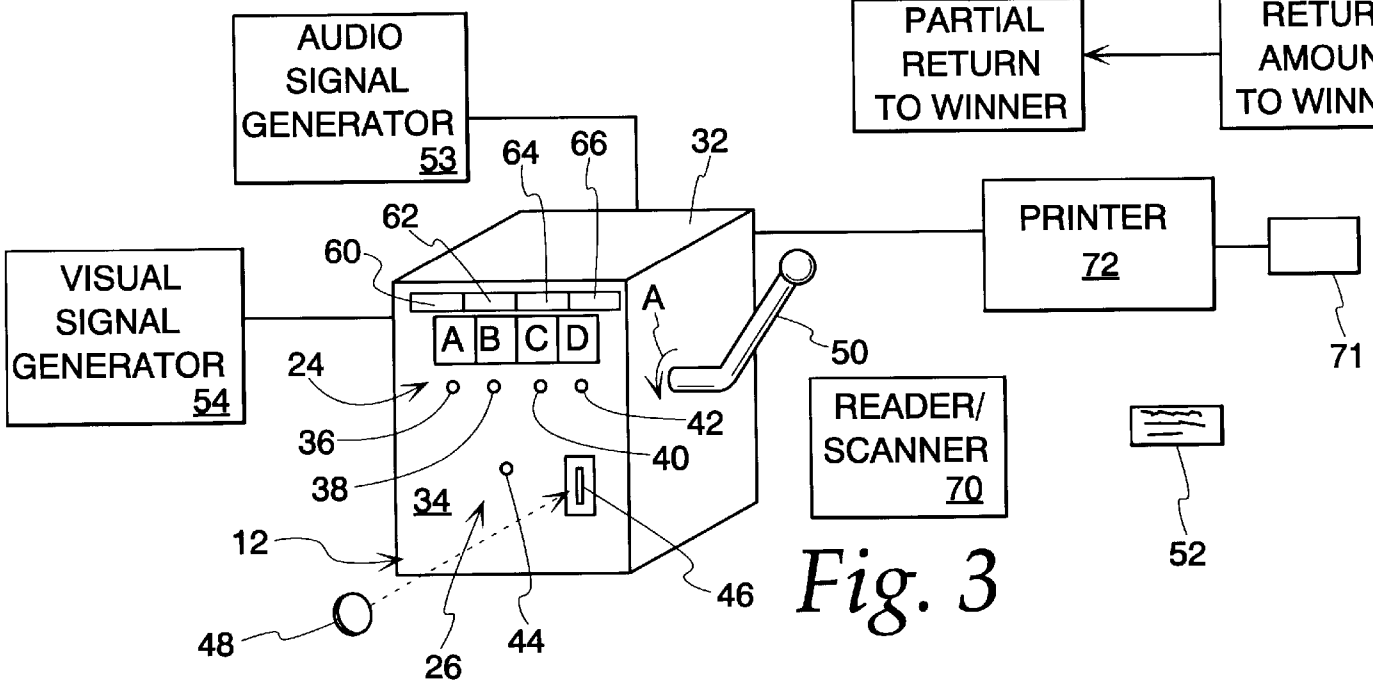
FIG. 3 is a perspective view of an input wagering terminal that is part of the wagering system in FIG. 2.

In FIG. 3, one preferred form of the input wagering terminal 12 is shown. The input wagering terminal 12 includes a housing 32 which simulates the appearance of a conventional slot machine. The housing 32 has a front display wall 34 with the selector 24 having push or slide button operators 36, 38, 40, 42 to identify each input wager as one or a combination of bet options A,B,C,D to be directed to the random number generator 20. Alternatively, the random selector 26 is operated through a push button or slide 44. The bet options A,B,C,D are readily viewable through front windows. The bet options A,B,C,D could be displayed on conventional mechanical reels, as a video image, or by using a combination of both of these technologies.

The housing 32 has a slot/opening 46 for a coin 48 that is processed to initiate the betting process. After inputting the coin 48, a repositionable lever 50, in this case a pivotable operating arm as used on slot machines, is pivoted in the direction of the arrow A to operate an internal switch 28 that thereby causes the input wager to be directed to the random number generator 20. As an alternative to a coin actuator, a reader or scanner 51 could be used to identify information on a card 52 to initiate operation. With the above described system, the operator will have the convenience and thrill of playing a conventional slot machine, potentially realizing an immediate preliminary, partial return amount, with the added thrill of waiting to anticipate an even higher final return amount after the predetermined racing period has expired.

To add another dimension to the system 10, an audio signal generator 53 and/or a visual signal generator 54 can be used to produce effects that simulate an equestrian event, simulate a live race environment, assist placement of input wagers, identify the beginning of a wagering period, identify the end of a wagering period, simulate a live game environment, or otherwise add to the excitement or authenticity of the system 10. The actual race or game from which the wagering base in the random number generator 20 is derived may be re-run/re-played on a video screen and/or audibly at the terminal 12 or re-played in an audio format. As a further alternative, a live horse/dog race and/or jai alai game may be broadcast in real time audibly and/or visually through the system 10.

Some specific wagering processes that might be practiced using the inventive system 10 and method will be described below. After a number of races are run and the results/outcome tabulated, some 60–90 or more individual results (example win, quinella, exacta, trifecta, superfecta) are selected for use by the invention as the wagering base 22. The outcomes can be from the same race or a combination of different races. A typical wagering period may be 5 to 30 minutes, although the wagering period is discretionary with the operator.

Outcome No. 1
No. 1 won and paid $12
Outcome No. 2
No. 8-6 perfecta won and paid $50
Outcome No. 3
No. 3-7-9 trifecta won and paid $340
Outcome No. 4
Nos. 9-7-1-2 superfecta won and paid $3,000

The odds for a No. 1 win were 5 to 1, i.e. 1 chance in six. The resulting probability is 0.1666666667. The odds for the perfecta were 24 to 1, i.e. 1 chance in 25. The resulting probability is 0.04. The odds for the trifecta were 169 to 1, i.e. 1 chance in 170. The resulting probability is 0.0058823529. The odds for the superfecta were 2,999 to 1, i.e. 1 chance in 3,000. The resulting probability is 0.0003333333.

The bettor determines how much to bet on a particular outcome. In this particular example, a $2 wager could be made on each of the four or five possible outcomes/bet options A,B,C,D and possibly the quinella (E). The input wager would typically be from $0.25 up to $50.00. This amount can be more or less depending upon the particular jurisdiction determination.

The bettor is given the option of placing any permitted amount on any one or a combination of the four/five outcomes using the selector 24. Alternatively, the bettor can proceed using the random mode so that the input wager is distributed randomly between the four/five outcomes using the selector 26.

The selector 24 can also be set to allow even distribution of an input wager over the four/five outcomes. This betting technique would be popular as it would produce many small "consolation" payoffs (very similar to the frequent small payoffs of conventional slots). While a player who bet just $0.25 may not access the superfecta, the perfecta outcome might be accessed. In that case, 6¼ cents would have been placed on this outcome as a result of which the bettor would ultimately receive roughly $1.50 back on this bet.

The wagering outcomes can also be "sequenced" so that by betting on and accessing one of the outcomes, one to three of the other outcomes might likewise be accessed. As an example of this, there could be the following four outcomes/bet options.

Win 6 paid $10.00;
perfecta 6-8 paid $52.00;
trifecta 6-8-9 paid $388.00; and
superfecta 6-8-9-1 paid $2,940.00.

If the input wager was identified as the 6-8-9-1 outcome, the bettor would win on all four outcomes. An input wager of a 6-8-9-4 outcome would access both the win 6, perfecta 6-8 and trifecta 6-8-9 outcomes. An exemplary payout for the 6-8-9-1 outcome might be $200 for a single quarter. A bet of $0.25 on the superfecta alone might produce $800, with a $2.00 bet potentially returning over $6,000.00.

Once the selector 24, 26 is chosen and set, and the input wager is made, the switch 28 is operated. The outcome is then determined entirely by chance based on the "assigned probability" to each of the outcomes in the random number generator 20. During the wagering period, the non-accessing/losing wagers are discarded as in regular slot machines. Those input wagers that are winners are recorded and an immediate preliminary, partial return amount is identified and may be paid to the winner.

As an example, the computer/processor 19 may calculate that 12,000 individual $1.00 win bets were made throughout the entire betting network, with a $12,000 total bet. With a success probability of 1 in 6, 2,000 winning pulls are expected by the assigned probability. Based upon chance, the win pulls will normally vary within the range of 1800 to 2200.

With only four outcomes bet upon in this particular embodiment, large pools can be expected. The large pools allow relatively precise prediction on payoffs, with fairly large probabilities ($3.00 to $500.00).

In this example, if only 1800 winning pulls occurred, the computer/processor 19 would determine the total available pool as $12,000 minus a 6% commission of $720.00, producing a total pool of $11,280.00. For simplicity, if everyone in the betting system bet $1.00, the pool to be divided by the 1800 winners would be $11,280.00 minus $1800.00 for the win bets, or $9,480.00. This $9,480.00 is divided by 1800 winners, resulting in approximately $6.26 paid off to each win bet. A $2.00 bet would have returned $12.52 as opposed to the "target payoff" of $12.00 that the No. 1 win paid in the actual race.

Were there 2,000 winners, as expected, the payoff of $2.00 would be $11.28. The payoff is less than the expected $12.00 in that the above example was simplified. With the No. 1 win paying $12.00, a 1 in 6 probability was assigned. Because approximately 18% was taken out of the win pool in the actual race, the real betting probability on this outcome was actually around 1 chance in 7 (0.1428571428) as opposed to the calculated probability of 0.1666666667 above. The random number generator 20, in the actual operative embodiment, will be programmed to reconcile the different commissions between two different betting pools, i.e. the actual versus the inventive. Accordingly, when the expected number of winners, less than the expected number, or more than the expected number, actually result, the appropriate payoff is either at, above, or below the "target payoff".

With this system, operating players can bet in the pari-mutuel format after the races have been run and the outcomes published. "Fixed" races would not affect the outcome.

Special race formats may be set up to produce very large payoffs. For example, a superfecta of around $50,000 could be targeted. In some cases, the payoff can be made for 1-2-3,- all or the pool could be carried over with a special "daily" game played only on one or multiple specific days of the week. Alternatively, the bets can be placed only on-track as opposed to being available in off-track betting facilities. The carryover can build to conceivably $1,000,000 and be publicized to promote the track. This would be similar to the large, "progressive jackpots" offered by traditional slots in casinos.

There are virtually a limitless number of different variations for betting that can be programmed into the inventive system 10 using the above basic teachings. To keep the invention fresh and popular, these variations would be introduced just as variations are introduced into conventional slot machines from time to time. One notable example would be the use of the popular horseracing bet, the box bet, which would greatly stimulate play.

The above system 10 is set up in a pari-mutuel racing format, as regulated by statute in most states. As a result, the use of the inventive system at live race tracks and at game facilities is permitted by law in most, if not all, jurisdictions, affording to the bettor the same thrill and advantage of conventional slot machines.

Of course, non-pari-mutuel type betting can take place using the inventive system. In this case, the random number generator 20 would determine payout based on underlying race or game results without using the pari-mutuel pooling and payout method. A fixed percentage payout of approximately 90–98% would be programmed into the random number generator's yield.

Alternatively, one large racing game can be conducted statewide. Smaller groups of 1-2 off-track betting facilities/tracks may adequately provide the necessary pool size and bet liquidity. This would protect against breakdowns and isolation of betting groups through hardware/software failure. Backup computers can be used to assure reliability in large systems, even those on a statewide basis.

The invention also allows the bettor to use mathematical skills, money management skills, and knowledge of pari-mutuel payouts in relation to commissions taken, and also offers another dimension that parallels handicapping skills in conventional horse race wagering based upon "value". "Value" is the identification of an overlay. A subjective interpretation of a myriad of factors lets the horse player assign a probability to a horse for winning a race. If the odds are higher than this assigned probability, "value" exists. The invention adds to the meaning of "value" by bringing an objective interpretation into play.

After all bets have been placed on a horse race, the closing odds (converted into a decimal probability) is the best estimation of the real probabilities of each horse's chances in a given race. This is empirically established by the fact that consistently over some 60 years of pari-mutuel wagering all over North America, favorites have won more than second choices, seconds win more than thirds, etc. The closing odds of a race serve as a starting point for establishing the probabilities, as determined by the betting public, of a given horse in a race to win.

With the present invention, the computer/processor 19 is programmed with the actual outcome/results of a race with each horse's probability. As the input wagers are directed to the random number generator 20, money accumulates in the pari-mutuel pools. The computer/processor 19 tabulates these results. Depending upon the results that are accumulating, the payout odds will vary above and below the fixed probability values derived from the closing odds of the underlying race. Accordingly, the winning payout odds for any input wager varies over the wagering period.

This variable effect can be illustrated by analogy to coin flipping. With two individuals flipping a coin 1,000 times, the results may be 513 heads and 487 tails. At this point, heads may pay 9–10 and tails 11–10, even though the predetermined probability value programmed into the computer/processor 19 was 0.5 or payout odds of 1—1 heads and tails. Chance events cause the odds to become variable even with the fixed probability.

In the present invention, as the wagering period progresses, typically over a 20 to 30 minute time interval, the money accumulates in the pari-mutuel pools, and the payout odds for each winner of each betting pool will vary above and below the expected, pre-assigned probability value. Some will vary more radically than others, while others will stay relatively close to predicted probabilities.

To allow the bettor to exercise wagering skills, in one form of the invention, the terminal 12 incorporates displays 60, 62, 64, 66 which generate a visible updated payout odds for each of the set options A, B, C, D. The computer/processor 19 may be programmed to display the recalculated, updated payout odds for each set option every thirty seconds throughout the wagering period, or at any other desired interval.

The player using the present invention, by recognizing overlay/underlays, deriving from fluctuations of the payout odds versus the underlying probabilities during the later stages of the wagering period, objectively identifies value.

Another example below illustrates how wild swings in the odds may be avoided with the inventive system. In one hypothetical case, a coin is flipped 1000 times, and results in 520 heads and 480 tails. If this were made into a pari-mutuel pool, tails might pay $4.40 (heads $3.60) on a $2 bet. With the event half over, another 1000 flips are still to be conducted. An astute gambler using skills of probability analysis will recognize that tails is the best bet at this point since with another 1000 flips the best prediction is that 1020 heads and 980 tails will result. This is because it can reasonably be assumed that heads and tails have a probability of 0.5 each. Therefore, because tails showed up only 480 times originally (in the first 1000 flips), there is a surplus of money in the pari-mutuel pool to pay for tails even if the next 1000 flips divides out equally 500/500. For illustrative purposes only, after 2000 flips, tails might still pay $4.20 and heads $3.80. This slower dampening is in marked contrast to the direct wagers in conventional wagering that often drives a 4–1 "value" (something which is widely held to adversely effect the handle of conventional pari-mutuel wagering) quality play into an 8–5 underlay that totally lacks value.

The effect of these mild aberrations in odds could dramatically increase handle in the last 5–8 minutes of wagering as players realize that "positive" payback exists. But regular players (probably ⅔ or more) will not care that much and will be happy to hit a 285–1 that perhaps should have been 300–1. The mix of different players could keep the machines busy constantly with great rushes at the end of the 30 minute wager period where horse players and good slot players may wager large amounts with the real expectation of statistically positive paybacks.

Figure 4:
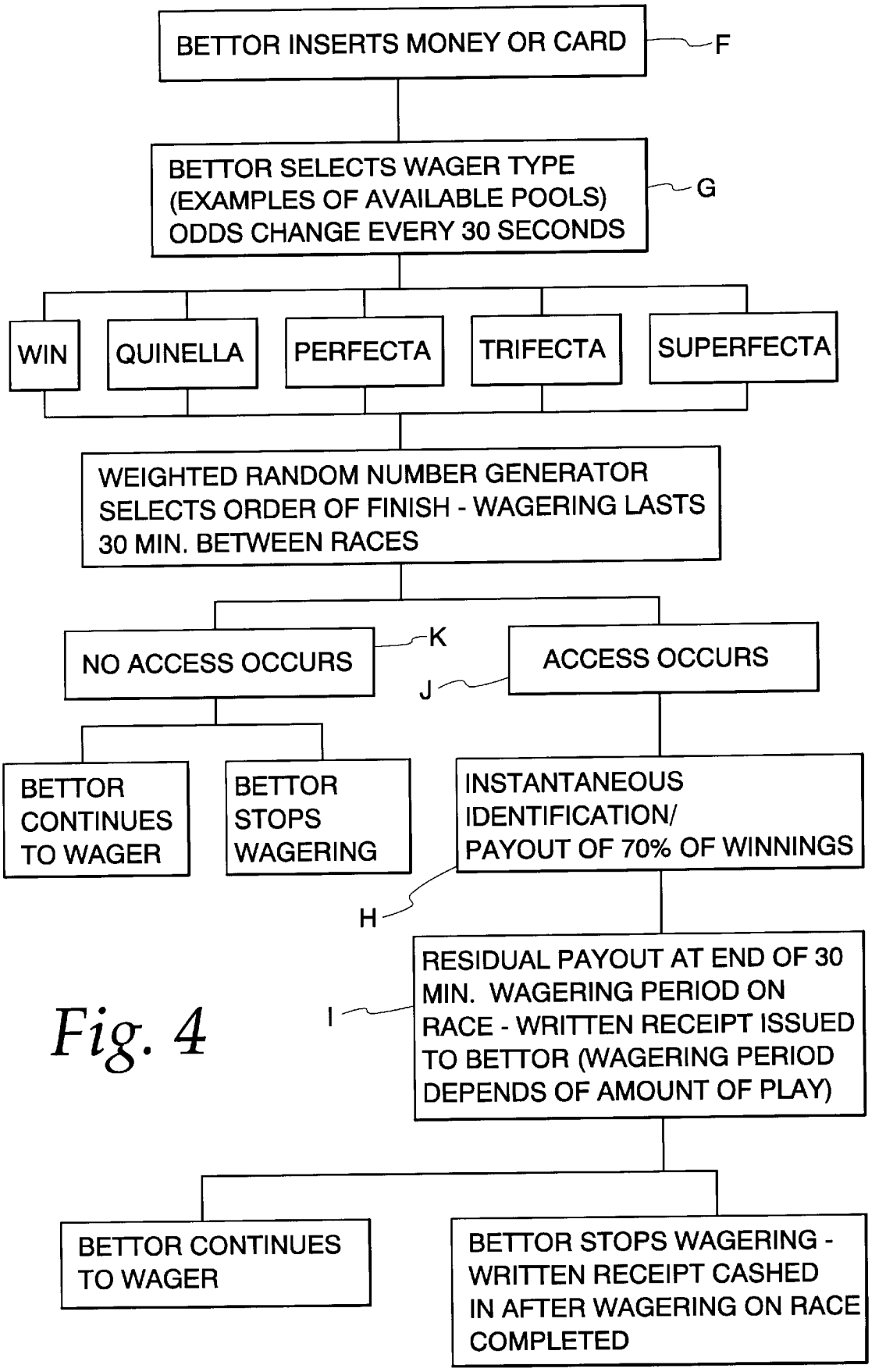
FIG. 4 is a flow diagram showing different wagering possibilities according to the present invention.
Figure 5:
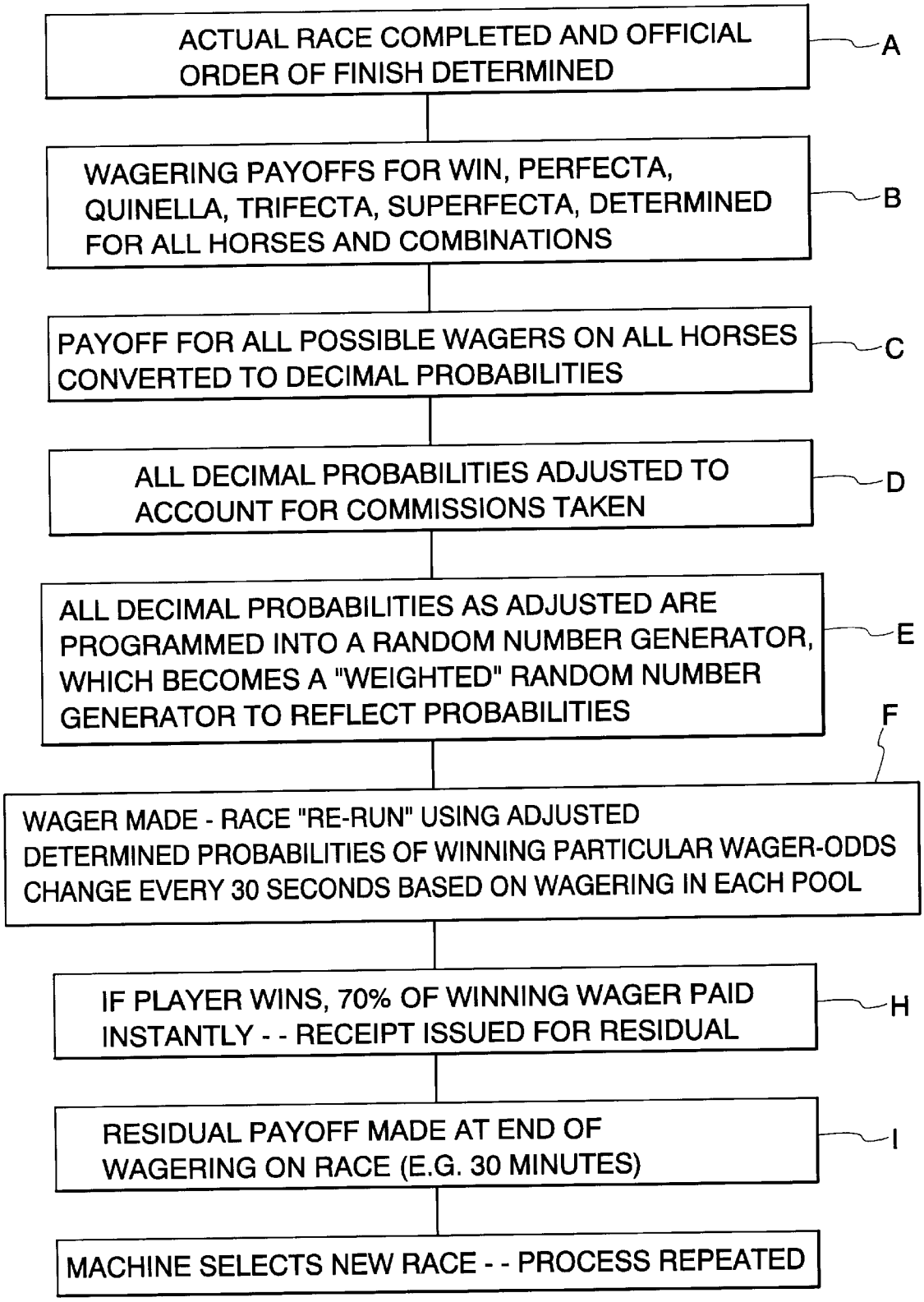
FIG. 5 is another flow diagram as in FIG. 1 showing the overall operation of the present invention in greater detail.

Further examples of the operation of the inventive system are described below with reference being made to FIGS. 4 and 5 for clarification.

The following example uses as an example a perfecta bet, with it understood that 5 or 6 bets may be placed simultaneously for each race played. A perfecta bet requires the bettor to select the first and second place horses in their exact order.

As shown at blocks A and B, an actual race is run. In this example, the number 4 and number 6 horses finish first and second, so that the 4-6 perfecta pays $102.00 for a $2.00 bet. The number 5 horse finished third.

The odds were 50 to 1 against horse No. 4 finishing first and horse No. 6 finishing second. 50–1 equals 1/51 chance of success and a 50/51 chance failure. Converting 1/51 into decimal form, as in block C, the success probability is 0.019607843, or just under a 2% chance. As shown in block D, all the decimal probabilities are adjusted to account for commissions taken.

As shown in block E, all adjusted decimal probabilities are programmed into the random number generator 20, which becomes a "weighted" random number generator to reflect probabilities. The random number generator is programmed so that 4-6 will show up 1.9607843% of the time on the average for each input wager.

As shown in block F, a bettor places a $1.00 bet and perhaps selects the perfecta at 50 to 1 odds. The input wager can be by way of the previously described coin 48 or card 52, with the latter processed by a reader/scanner 70. After making the selection of the bet option A,B,C,D, corresponding win, quinella, perfecta, trifecta, superfecta, (and in this example, the perfecta), in block G, the bettor operates the lever 50 to cause the input wager to be directed to the random number generator 20.

The input wager is directed to the random number generator 20 from all locations 12, 14, 16, 18 simultaneously. A desired betting period is predetermined and may be on the order of 20–30 minutes, or longer or shorter as bet volume dictates.

The standard pari-mutuel pool is established for each type of input wager with the given race/game and its offered bets. For example, the win pool, perfecta pool, quinella pool, trifecta pool, and superfecta pool would each have individual target winning numbers, with individual probabilities correlated to the odds of the horses that finished in the actual race.

In the example used in the 4-6 perfecta, assume that $50,000 total was bet in 30 minutes and the average bet was exactly $1.00. It can be estimated that in the 50,000 trials, about 980 winning bets should be produced at the end of the race (50,000×0.19607843=980.4). Forgetting commissions for purposes of simplicity, dividing $49,020 by 980 gives $50.02 for each $1.00 bet. In pari-mutuel wagering in horse racing, the winning wagers are deducted from the total available pool before the payoffs are determined. In this example, $980.00, representing 980 winning $1.00 wagers, is deducted from $50,000, leaving $49,020. Thus, for a $2.00 bet, the bettor receives $100.04 and the $2.00 bet back for a total of $102.04, which matches the actual 4-6 payout of the original race. Using this expected payout, as shown at block H, 70% or $71.40 can be paid out to any bettor that input a wager on 4-6 and accessed the 4-6 combination on the machine even if this was done at the start of the race period before any money accumulates in the pari-mutuel pool.

In one form, the identified amount to be paid out can be identified on a ticket 71 generated by a printer 72. The printed ticket 71 functions as a receipt for the preliminary, 70% initial payout and the right to the residual payout. At the end of the predetermined betting period, the bettor can redeem the ticket 71 for the full payout, as shown in block I.

During the predetermined betting period, the bettor can place multiple bets when either as at block J, the input wager accesses the corresponding race outcome, or as at block K, the input wager does not access the corresponding race outcome in the random number generator 20.

The invention also contemplates a terminal with a switch that allows the bettor to change between betting on live races and betting according to the present invention, as described above.

Variations of the above method are also contemplated. For example, before the horse/dog race or jai alai game is completed, the bettors may pre-deposit a wager. After the conclusion of the horse/dog race or jai alai game, the bettor can then choose what bet to play i.e. win, quinella, perfecta, trifecta, superfecta. The bettor would then be limited to the amount wagered before the race/game. Practicing the invention in this manner permits the total pari-mutuel handle to be determined before the underlying horse/dog race or jai alai game takes place. The actual distribution of the total handle to the individual pools would not be determined until after the wagering period is completed.

Another variation involves proceeding as in the prior paragraph but pre-depositing the wagered money to designated pools i.e. win, quinella, perfecta, trifecta, superfecta. The separate pari-mutuel pools would then be predetermined in the same manner as pure conventional and traditional bets at race tracks i.e. the bets would actually be designated as, for example, $20 pre-race deposited - all $1 bets: 5-wins, 3-quinellas, 2-perfectas, 2-trifectas, 8-superfectas.

In another variation, the bettor pre-deposits the amount of money to be bet on a horse/dog race or jai alai game after which the bettor either designates the pools into which the bets are to be made (win, quinella, perfecta, trifecta, superfecta), or lets the bets be randomly assigned. Hardware that can be used that is either a) choice and random or b) no choice.

After the race or jai alai game is concluded, only the numbers of the horses are posted. What is paid is of no consequence in this process. The machines have "secretly" kept the actual numbers assigned by the conventional random number generator, with each number equally likely to come up for each win, quinella, perfecta, trifecta or superfecta bet made. Since the money was all pre-deposited and the numbers randomly, and "secretly" bet, the pools may be calculated pari-mutuelly exactly as in any other conventionally made race track bet. However, the pools will be kept distinct from other pools. Commission should be less (on the order of 6–8%) and payouts are instant once the horse numbers are posted. With this arrangement, those practicing the invention do not know if they have won until they activate the lever 50. Winners then come up instantly with a complete payback of 100% made instantly.

The foregoing disclosure of specific embodiments is intended to be illustrative of the broad concepts comprehended by the invention.

I claim:

1. A method of wagering comprising the steps of:

providing a random number generator that has a wagering base which is randomly accessed through an input wager;

using as at least a part of the wagering base the outcome of at least one horse/dog race or jai alai game that has been completed;

pre-assigning a probability value to the outcome of the at least one horse/dog race or jai alai game and programming the random number generator so that the probability of accessing the outcome of the at least one horse/dog race or jai alai game in the random number generator through an input wager identifying the outcome of the at least one horse/dog race or jai alai game is correlated to the probability value;

directing an input wager identifying the outcome of the at least one horse/dog race or jai alai game to the random number generator; and identifying a return for an input wager identifying the outcome of the at least one horse/dog race or jai alai game that accesses the outcome of the at least one horse/dog race or jai alai game in the random number generator.

2. The method of wagering according to claim 1 including the steps of providing multiple locations from which input wagers are directed to the random number generator and directing input wagers to the random number generator from each of the multiple locations.

3. The method of wagering according to claim 2 wherein the step of identifying a return comprises the step of identifying a return that is determined by the number of input wagers identifying the outcome of the at least one horse/dog race or jai alai game that access the outcome of the at least one horse/dog race or jai alai game through the random number generator.

4. The method of wagering according to claim 2 including the step of identifying a predetermined wager period, the step of directing an input wager comprises the step of directing an input wager to the random number generator only during the predetermined wager period, and further including the step of identifying a preliminary return amount for an input wager identifying the outcome of the at least one horse/dog race or jai alai game that accesses the outcome of the at least one horse/dog race or jai alai game through the random number generator before the expiration of the predetermined wager period.

5. The method of wagering according to claim 4 including the step of identifying a final return amount for each input wager identifying the outcome of the at least one horse/dog race or jai alai game that accesses the outcome of the at least one horse/dog race or jai alai game through the random number generator during the predetermined wager period at the expiration of the predetermined wager period based upon the total number of input wagers identifying the outcome of the at least one horse/dog race or jai alai game from each of the multiple locations that access the at least one horse/dog race or jai alai game through the random number generator during the predetermined wager period.

6. The method of wagering according to claim 4 including the step of printing a receipt which identifies that an input wager identifying the outcome of the at least one horse/dog race or jai alai game has accessed the outcome of the at least one horse/dog race and jai alai game in the random number generator.

7. The method of wagering according to claim 2 including the steps of identifying a money value for each input wager and determining a cumulative money pool value for the total input wagers made from the multiple locations identifying the outcome of the at least one horse/dog race or jai alai game that access the outcome of the at least one horse/dog race or jai alai game through the random number generator, and the step of identifying a return comprises the step of identifying a return to each input wager identifying the outcome of the at least one horse/dog race or jai alai game that accesses the at least one horse/dog race or jai alai game based on the cumulative money pool value.

8. The method of wagering according to claim 1 including the steps of providing additional information to define another part of the wagering base, preassigning a second probability value to the additional information and programming the random number generator so that the probability of accessing the additional information in the random number generator through an input wager identifying the additional information is correlated to the second probability value, providing an input wagering terminal with a selector to allow an input wager to be selectively identified as one of a) the outcome of the at least one horse/dog race or jai alai game and b) the additional information, directing an input wager identifying the additional information to the random number generator, and identifying a return for an input wager identifying the additional information that accesses the additional information through the random number generator.

9. The method of wagering according to claim 1 including the steps of providing an input wagering terminal and processing a discrete object that is inserted into the input wagering terminal to cause an input wager identifying the outcome of the at least one horse/dog race or jai alai game to be directed to the random number generator.

10. The method of wagering according to claim 9 wherein the input wagering terminal has a repositionable element that is accessible to an operator, and the step of processing a discrete object comprises the step of repositioning the repositionable element after the discrete object is inserted into the input wagering terminal.

11. The method of wagering according to claim 1 including the steps of providing an input wagering terminal and at the input wagering terminal producing at least one of an audio and visual signal to at least one of a) simulate an equestrian event, b) simulate a live race environment, c) assist placement of input wagers, d) identify the beginning of a wagering period, e) identify the end of a wagering period, f) simulate a live game environment, g) audibly or visually reproduce at least part of the at least one horse/dog race or jai alai game, h) audibly or visually broadcast an actual horse/dog race in real time, and i) audibly or visually broadcast an actual jai alai game in real time.

12. The method of wagering according to claim 1 including the steps of providing additional information to define another part of the wagering base, preassigning a second probability value to the additional information, programming the random number generator so that the probability of accessing the additional information in the random number generator is correlated to the second probability value, and providing an input wagering terminal that causes an input wager directed to the random number generator to randomly be identified as at least one of a) the outcome of the at least one horse/dog race or jai alai game, and b) the additional information.

13. The method of wagering according to claim 1 including the steps of operating the random number generator for a predetermined wagering period and identifying an updated payout odds value for accessing the outcome of the at least one horse/dog race or jai alai game in the random number generator through an input wager identifying the outcome of the at least one horse/dog race or jai alai game, which updated payout odds value may change from the preassigned probability value based upon the number of input wagers identifying the outcome of the at least one horse/dog race or jai alai game that have accessed the outcome of the at least one horse/dog race or jai alai game in the random number generator.

14. A wagering system comprising:

a random number generator that has a wagering base which is randomly accessed by an input wager, said wagering base comprising the outcome of at least one horse/dog race or jai alai game that has been completed with a preassigned probability value for accessing the outcome of the at least one horse/dog race or jai alai game through each input wager; and a first input wagering terminal for directing an input wager identifying the outcome of the at least one horse/dog race or jai alai game to the random number generator.

15. The wagering system according to claim 14 including a second input wagering terminal for directing an input wager identifying the outcome of the at least one horse/dog race or jai alai game to the random number generator.

16. The wagering system according to claim 15 including a processor for determining the number of input wagers identifying the at least one horse/dog race or jai alai game directed from the first and second input wagering terminals to the random number generator that accessed the at least one horse/dog race or jai alai game in the random number generator.

17. The wagering system according to claim 14 wherein the first input wagering terminal includes an actuator switch for causing an input wager to be directed to the random number generator.

18. The wagering system according to claim 14 wherein the wagering base comprises additional information that defines another part of the wagering base with there being a preassigned probability of accessing the additional information through each input wager identifying the additional information, the first input wagering terminal comprises a selector that can be set in first and second states, said selector in the first state causing an input wager identifying the outcome of the at least one horse/dog race or jai alai game to be directed to the random number generator, said selector in the second state causing the input wager to cause an input wager identifying the additional information to be directed to the random number generator.

19. The wagering system according to claim 14 wherein the wagering base comprises additional information that defines another part of the wagering base with a preassigned probability value for accessing the additional information through each input wager identifying the additional information, and the first input wagering terminal comprises a selector for causing an input wager directed to the random number generator to be randomly identified as the at least one horse/dog race or jai alai game and the additional information.

20. The wagering system according to claim 14 wherein there is a generator at the terminal for producing at least one of an audio and visual signal to at least one of a) simulate an equestrian event, b) simulate a live race environment, c) assist placement of input wagers, d) identify the beginning of a wagering period, e) identify the end of a wagering period, f) simulate a live game environment g) audibly or visually reproduce at least part of the at least one horse/dog race or jai alai game, h) audibly or visually broadcast an actual horse/dog race in real time, and i) audibly or visually broadcast an actual jai alai game in real time.

21. The wagering system according to claim 14 wherein the wagering base comprises additional information that defines another part of the wagering base with a pre-assigned probability value of accessing the additional information through each input wager identifying the additional information, and the additional information comprises information on the outcome of a horse/dog race or jai alai game that has been completed.

22. The wagering system according to claim 21 wherein at least one of the preassigned probability values is substantially the same as the probability of the outcome of the horse/dog race or jai alai game to which it relates.

23. The wagering system of claim 21 further comprising a processor for determining an updated payout odds value for accessing the outcome of the at least one horse/dog race or jai alai game in the random number generator through an input wager identifying the outcome of the at least one horse/dog race or jai alai game, which updated payout odds value may change from the pre-assigned probability value based upon a number of input wagers identifying the outcome of the at least one horse/dog race or jai alai game that have accessed the outcome of the at least one horse/dog race or jai alai game in the random number generator.

24. The wagering system according to claim 23 further comprising a display for identifying to a user of the wagering system the updated payout odds value.

25. The wagering system according to claim 14 wherein the first input wagering terminal comprises means responsive to the insertion of a discrete object by an operator to direct an input wager to the random number generator.

26. The wagering system according to claim 14 further comprising a processor for determining an updated probability value for accessing the outcome of the at least one horse/dog race or jai alai game in the random number generator through an input wager identifying the outcome of the at least one horse/dog race or jai alai game, which updated payout odds value may change from the pre-assigned probability value based upon a number of input wagers identifying the outcome of the at least one horse/dog race or jai alai game that have accessed the outcome of the at least one horse/dog race or jai alai game in the random number generator.

27. The wagering system according to claim 14 further comprising a printer for producing a receipt which identifies that an input wager identifying the outcome of the at least one horse/dog race or jai alai game has accessed the outcome of the at least one horse/dog race or jai alai game in the random number generator through an input wager.

28. A wagering system comprising:

a random number generator having a wagering base that is randomly accessed through an input wager and having as at least part of the wagering base the outcome of at least one horse/dog race or jai alai game which has been completed and which has a pre-assigned probability value, wherein the random number generator is programmed so that the probability of accessing the outcome of the at least one horse/dog race or jai alai game in the random number generator through an input wager identifying the outcome of the at least one horse/dog race or jai alai game is correlated to the pre-assigned probability value.

29. The wagering system according to claim 28 further comprising a slot/opening for accepting a coin to initiate the direction of an input wager to the random number generator.

30. The wagering system according to claim 28 further comprising a reader/scanner for identifying information on a card to initiate the direction of an input wager to the random number generator.

31. The wagering system according to claim 26 further comprising a printer for producing a receipt which identifies that an input wager identifying the outcome of the at least one horse/dog race or jai alai game has accessed the outcome of the at least one horse/dog race or jai alai game in the random number generator.

32. The wagering system according to claim 26 further comprising a processor for identifying a preliminary return amount to be paid to a user that has accessed the outcome of the at least one horse/dog race or jai alai game in the random number generator through an input wager identifying the outcome of the at least one horse/dog race or jai alai game, which preliminary amount is based on the total number of input wagers identifying the outcome of the at least one horse/dog race or jai alai game that have accessed the outcome of the at least one horse/dog race or jai alai game in the random number generator after a predetermined wagering period.

33. The wagering system according to claim 26 further comprising a processor for identifying a final return amount to be paid to a user that has accessed the outcome of the at least one horse/dog race or jai alai game in the random number generator through an input wager identifying the outcome of the at least one horse/dog race or jai alai game upon the conclusion of a wagering period that extends beyond the predetermined wagering period.

34. The wagering system according to claim 26 wherein the wagering system comprises multiple locations at which input wagers can be directed to the random number generator.

35. The wagering system according to claim 26 wherein the wagering base in the random number generator comprises additional information that is assigned a second probability value and the random number generator is programmed so that the probability of accessing the additional information in the random number generator through an input wager identifying the additional information is correlated to the second probability value and there is a selector for allowing an input wager to the random number generator to be selectively identified as a) the outcome of the at least one horse/dog race or jai alai game and b) the additional information.

36. The wagering system according to claim 26 wherein the wagering system further comprises a repositionable element that is repositioned by an operator to cause an input wager to be directed to the random number generator.

37. The wagering system according to claim 36 wherein the repositionable element comprises a repositionable lever.

38. The wagering system according to claim 37 wherein the repositionable lever is a pivotable lever.

39. The wagering system according to claim 26 further comprising a generator for at least one of an audio and a video signal to at least one of a) simulate an equestrian event, b) simulate a live race environment, c) assist placement of input wagers, d) identify the beginning of a wagering period, e) identify the end of a wagering period, f) simulate a live game environment g) audibly or visually reproduce at least part of the at least one horse/dog race or jai alai game, h) audibly or visually broadcast an actual horse/dog race in real time, and i) audibly or visually broadcast an actual jai alai game in real time.

40. The wagering system according to claim 26 further comprising an actuator switch that is operable by a user of the wagering system to direct an input wager to the random number generator.

41. A wagering system comprising:

a weighted random number generator that has a wagering base which is randomly accessed by an input wager, said wagering base comprising the outcome of at least one horse/dog race or jai alai game that has been completed with a preassigned probability value for accessing the outcome of the at least one horse/dog race or jai alai game through each input wager; and a first input wagering terminal for directing an input wager identifying the outcome of the at least one horse/dog race or jai alai game to the weighted number generator.

42. A method of wagering comprising the steps of:

providing a random number generator that has a wagering base that is derived at least in part from the outcome of at least one horse/dog race or jai alai game that has previously been completed;

identifying in the wagering base certain information in the wagering base that is based at least in part on the outcome of the at least one horse/dog race or jai alai game that has previously been completed and accessible through an input wager and wherein the probability of accessing the certain information in the wagering base through an input wager is different;

directing an input wager to the random number generator; and identifying whether the input wager has accessed any of the certain information in the wagering base.

43. The method of wagering according to claim 42 including the steps of providing multiple locations from which input wagers are directed to the random number generator and directing input wagers to the random number generator from each of the multiple locations.

44. The method of wagering according to claim 43 including the step of identifying a return for an input wager that has accessed the certain information in the wagering base.

45. The method of wagering according to claim 44 wherein the step of identifying a return comprises the step of identifying a return that is determined by the number of input wagers that have accessed the certain information in the wagering base.

46. The method of wagering according to claim 45 including the step of identifying a wagering period, and the step of directing an input wager comprises the step of directing an input wager to the random number generator only during the wagering period.

47. The method of wagering according to claim 46 including the step of identifying a final return amount for each input wager that accesses the certain information during the wagering period at the expiration of the wagering period based upon the total number of input wagers that access the certain information during the wagering period at the expiration of the wagering period.

48. The method of wagering according to claim 46 further including the step of identifying a preliminary return amount of an input wager that accesses the certain information in the wagering base before the expiration of the wagering period.

49. The method of wagering according to claim 44 including the steps of identifying a money value for each input wager and determining a cumulative money pool value for the total input wagers made from the multiple locations that access the certain information in the wagering base and the step of identifying a return comprises the step of identifying a return for each input wager that accesses the certain information based on the cumulative money pool value.

50. The method of wagering according to claim 44 including the step of printing a receipt which identifies that an input wager has accessed the certain information in the wagering base.

51. A wagering system comprising:

a random number generator that has a wagering base which is randomly accessed by an input wager, said wagering base comprising information based on the outcome of at least one horse/dog race or jai alai game that has previously been completed with a different probability value for accessing certain information in the wagering base through an input wager; and a first input wagering terminal for directing an input wager to the random number generator.

52. A method of wagering comprising the steps of:

providing a random number generator that has a wagering base that is derived at least in part from the outcome of at least one horse/dog race or jai alai game that has previously been completed;

identifying in the wagering base certain information in the wagering base that is based at least in part on the outcome of the at least one horse/dog race or jai alai game that has been completed and accessible through an input wager and wherein the probability of accessing the certain information in the wagering base through an input wager is different;

directing multiple input wagers to the random number generator;

determining a cumulative pool from a total of the multiple input wagers; and determining the percentage of the total pool that is attributable to each input wager that has accessed the certain information in the wagering base.

53. The method of wagering according to claim 52 including the steps of providing multiple locations from which input wagers are directed to the random number generator and directing input wagers to the random number generator from each of the multiple locations.

54. The method of wagering according to claim 53 including the step of identifying a wagering period, the step of directing an input wager comprises the step of directing an input wager to the random number generator only during the wagering period, and further including the steps of identifying a return amount of an input wager that accesses the certain information in the wagering base and identifying at least one pool comprising accumulated input wagers that access the certain information.

55. The method of wagering according to claim 54 including the step of identifying a return amount for each input wager that accesses the certain information during the wagering period based upon the total number of input wagers that accesses the certain information during the wagering period.

56. The method of wagering according to claim 52 including the steps of providing an input wagering terminal and processing a discrete object that is inserted into the input wagering terminal to cause an input wager to be directed to the random number generator.

57. The method of wagering according to claim 56 wherein the input wagering terminal has a repositionable element that is accessible to an operator, and the step of processing a discrete object comprises the step of repositioning the repositionable element after the discrete object is inserted into the input wagering terminal.

58. The method of wagering according to claim 52 including the steps of providing an input wagering terminal and at the input wagering terminal producing at least one of an audio and visual signal to at least one of a) simulate an equestrian event, b) simulate a live race environment, c) assist placement of input wagers, d) identify the beginning of a wagering period, e) identify the end of a wagering period, f) simulate a live game environment, g) audibly or visually reproduce at least part of the at least one horse/dog race or jai alai game, h) audibly or visually broadcast an actual horse/dog race in real time, and i) audibly or visually broadcast an actual jai alai game in real time.

59. The method of wagering according to claim 52 including the steps of directing multiple input wagers to the random number generator, operating the random number generator during a wagering period and identifying an updated probability for accessing certain information in the wagering base through an input wager which updated probability may change based upon the number of input wagers that have accessed the certain information in the wagering base.

60. The method of wagering according to claim 52 including the step of printing a receipt which identifies that an input wager has accessed the certain information in the wagering base.

61. A method of wagering comprising the steps of:

providing a random number generator that has a wagering base that is derived at least in part from the outcome of at least one horse/dog race or jai alai game that has previously been completed;

identifying in the wagering base certain information including statistical information in the wagering base that is based at least in part on the outcome of the at least one horse/dog race or jai alai game that has previously been completed and accessible through an input wager, with the statistical information usable to facilitate the selection of an input wager via a simulated live or live horse/dog race or jai alai game environment, wherein the probability of accessing the certain information in the wagering base through an input wager is different;

directing an input wager to the random number generator; and identifying whether the input wager has accessed any of the certain information in the wagering base.

* * * * *